US007918063B2

(12) United States Patent
Etemadi

(10) Patent No.: US 7,918,063 B2
(45) Date of Patent: Apr. 5, 2011

(54) GARAGE DOOR WINDOW

(76) Inventor: Hossein Etemadi, Lake Forest, CA (US)

( * ) Notice: Subject to any disclaimer, the term of this patent is extended or adjusted under 35 U.S.C. 154(b) by 107 days.

(21) Appl. No.: 12/550,661

(22) Filed: Aug. 31, 2009

(65) Prior Publication Data

US 2011/0047904 A1 Mar. 3, 2011

(51) Int. Cl.
*E06B 3/72* (2006.01)
*E05B 7/28* (2006.01)

(52) U.S. Cl. ..... 52/455; 52/208; 52/204.5; 52/212; 52/211; 52/210; 52/204.54; 52/656.5; 52/656.9; 40/706; 40/732; 40/734; 49/171

(58) Field of Classification Search ..... 52/204.1, 52/205, 207, 210–213, 204.5, 204.51, 208, 52/204.55, 204.56, 204.58, 204.593, 204.6, 52/656.9, 656.5; 49/171, 504, 505; 40/706, 40/732, 734

See application file for complete search history.

(56) References Cited

U.S. PATENT DOCUMENTS 2,008,275 A * 7/1935 Dyer ..... 335/180
2,009,031 A * 7/1935 Staples ..... 192/70.251
2,733,787 A * 2/1956 morra ..... 52/97
2,804,952 A * 9/1957 Nothdurft ..... 403/293
2,811,754 A * 11/1957 Toth ..... 49/316
2,841,834 A * 7/1958 Poole, Jr ..... 52/207
2,847,064 A * 8/1958 Leo ..... 160/267.1
3,293,821 A * 12/1966 Gilmore ..... 52/656.9
3,805,465 A * 4/1974 Dietrich ..... 52/235
3,885,367 A * 5/1975 Thunberg ..... 52/204.1
4,143,493 A * 3/1979 Booi ..... 52/127.12
4,307,542 A * 12/1981 Lense ..... 49/318
4,430,831 A * 2/1984 Kemp ..... 52/204.53
4,494,342 A * 1/1985 Decker ..... 52/203
4,570,399 A * 2/1986 Wentink ..... 52/208
4,839,989 A * 6/1989 McConnell ..... 49/171
6,230,455 B1 * 5/2001 Arehart et al. ..... 52/202
6,931,810 B2 * 8/2005 Beaudoin et al. ..... 52/455
7,010,888 B2 * 3/2006 Tumlin et al. ..... 52/204.56

* cited by examiner

*Primary Examiner* — Jeanette E. Chapman
(74) *Attorney, Agent, or Firm* — Clement Cheng

(57) ABSTRACT

A garage door window has an outside frame member which has an inside frame member connection. The inside frame member has a protrusion connecting with the inside frame member connection. There is also an outside retainer channel, an inside retainer channel and an outside retainer fitting within the outside retainer channel, with an inside retainer fitting with the inside retainer channel. The inside retainer is nondestructively removable relative the inside retainer channel by a snap fit. An outside track is formed on the outside frame member, between a central inside face of the outside frame member and the outside retainer. An inside track is formed on the outside frame member, between the outside retainer and the inside retainer. A screen is mounted on the outside track, a fixed window mounted on the outside track; and an active window is mounted on the inside track.

18 Claims, 12 Drawing Sheets

GARAGE DOOR WINDOW

The application claims priority from design application filed by same inventor Aug. 22, 2009 having express mail number EH373323455.

FIELD OF THE INVENTION

The present invention is in the field of garage door windows.

DISCUSSION OF RELATED ART

The modern garage door typically has a number of panels. Ornamental frame assemblies are typically mounted on a row of windows along the top panel. U.S. Pat. No. 6,763,638 to Berger issued Jul. 20, 2004, the disclosure of which is incorporated herein by reference, shows that transparent members are lodged in channels on frame members. Many of these ornamental frame assemblies are formed as a decorative overlay, also called the design. U.S. Pat. No. 5,497,588 issued Mar. 12, 1996 to Martin, the disclosure of which is incorporated herein by reference shows a window pane secured to a design by a number of bolts for easy alignment of the decorative overlay. Other decorative window assemblies have more complex construction was multiple layers of panels such as shown in U.S. Pat. No. 6,272,801 issued Aug. 14, 2001 to Suh, the disclosure of which is incorporated herein by reference. Unfortunately, these windows are fixed and cannot be opened for ventilation.

U.S. Pat. No. 3,927,709 issued December 1975 to Church provides a garage door with a plurality of hinged sections. Each of the hinged window sections can pivot open for ventilation. A number of rollers close the windows if the garage door is being opened while the windows are in open position. While the hinged sections are aesthetically pleasing, each window requires a pair of pistons such that eight windows would require a total of sixteen pistons which increases both the weight, complication and cost. A variety of related pivoting open windows are taught in the prior art for facilitating ventilation.

SUMMARY OF THE INVENTION

The outside frame member has a connection with the inside frame member. The other parts are mounted on the outside frame member. The outside frame member sandwiches together with the inside frame member so that they sandwich together onto a garage door opening on a garage door section. The inside frame member connection disposed on the outside frame member is preferably formed as a slot with a plurality of tooth like or saw like projections for grabbing onto the inside frame member. The tooth projections of the inside frame member connection are preferably opposing and angled outwardly on an upper and lower surface of the slot which receives an inside frame member protrusion. The inside frame member protrusion also has protruding tooth projections that are slanted outwardly engaging with the outwardly slanted protruding tooth projections of the inside frame member connection. The protruding tooth projections of the inside frame member protrusion and the protruding tooth projections of the inside frame member connection both can bend or have elastic or inelastic deformation so that they can engage with each other. Also, the lip can be biased by the push fit of the protruding tooth projections for additional locking strength or resilience.

The outside frame member has an outside face which is exposed to the elements. The outside face opposes a peripheral inside face which abuts the garage door section. An outside support is formed as a wall and an inside support is also formed as a wall which form a window design channel between them. The window design channel is sized to receive a variety of ornamental window designs such as a grid or a starburst. A wide variety of ornamental window designs can fit in the window design channel. The window design channel receives a flexible window design which is typically made of a pliable plastic that can be bent for fitting within the window design channel.

The inside support has a central inside face. The central inside face retains a pair of fixed members which includes a screen and a fixed window. The screen and the fixed window are both fixed and not movable. They are also both parallel to each other on the same plane. Preferably, the screen has a screen frame that abuts the fixed window frame of the fixed window.

The outside retainer channel and the inside retainer channel are disposed as a pair of retainer channels. The retainer channels retain a pair of retainers, namely an inside retainer and an outside retainer. The retainers are stick like and have flexibility. The retainers preferably fit into the retainer channels by snap fit installation, and optionally glue can be used, but is not preferred so that the retainers can be nondestructively removed from the retainer channels. Once in the retainer channel, a retainer has resistance against bending and movement which would lead it to fall out, but not necessarily against sliding along the direction of the length of the retainer channel. Preferably, the retainer channel and the retainer have a snug fit, although that is optional. The dimensions shown in the figures can be altered or adapted in shape if necessary for suiting a variety of different configurations.

After the retainers are inserted into the retainer channels, a pair of tracks is formed. An outside track is formed between the central inside face of the inside support and the outside retainer. An inside track is formed between the outside retainer and the inside retainer. The tracks, namely the pair of tracks are channel shaped as shown in the drawings, and can also be notch shaped. The screen is a typical window screen allowing air to pass through, but having mesh for the purpose of keeping out insects. The screen and the fixed window are preferably mounted on the outside track. The active window is preferably formed of a glass material similar to the fixed window. The active window may also include a locking latch that engages the inside track for locking the active window. The active window is preferably slidably mounted on the inside track. The lock latch may have a protrusion that engages a depression disposed on a surface of the inside track. Alternatively, the lock latch may be friction only engaged with a surface of the inside track.

During installation, a user first presses the outside frame member onto the outside of the garage door section. The user aligns the outside frame member so that the peripheral inside face meets the outside surface of the garage door section. The user also a lines the outside frame member so that the lip passes through the garage door opening. The garage door section is preferably made of a metal or plastic as is commonly known in the industry. Sometimes, the garage door section has insulation. The user can then place the screen and the fixed window against the central inside face. The user can then install the outside retainer. The user can then install the active window and hold the active window in place with the inside retainer. The user can then push the inside frame member having the inside frame member protrusion aligned with the inside frame member connection so that the frame members become snapped together with each other.

Alternatively, a user can first install the outside frame member against the inside frame member. In this installation, the user can grasp the interface of the outside frame member against the inside frame member using opposable digits. The user then installs the screen and fixed window, followed by the outside retainer for retaining the screen and fixed window. The user can then install the active window followed by the inside retainer for retaining the active window. After installing the active window, the user may wish to test the active window by sliding the active window from a closed position to an open position, and then sliding the active window between the open and closed positions.

Preferably, the active window is snug enough to fit in the outside track so that it does not rattle when the garage door is opened. Also, the active window should not be so snug as to have difficulty opening. A user can open the active window to allow airflow through the screen. If a window is broken, the user can remove the inside retainer for replacing the active window, and the user can remove the inside retainer, active window and the outside retainer for replacing the fixed window.

Figure 1:
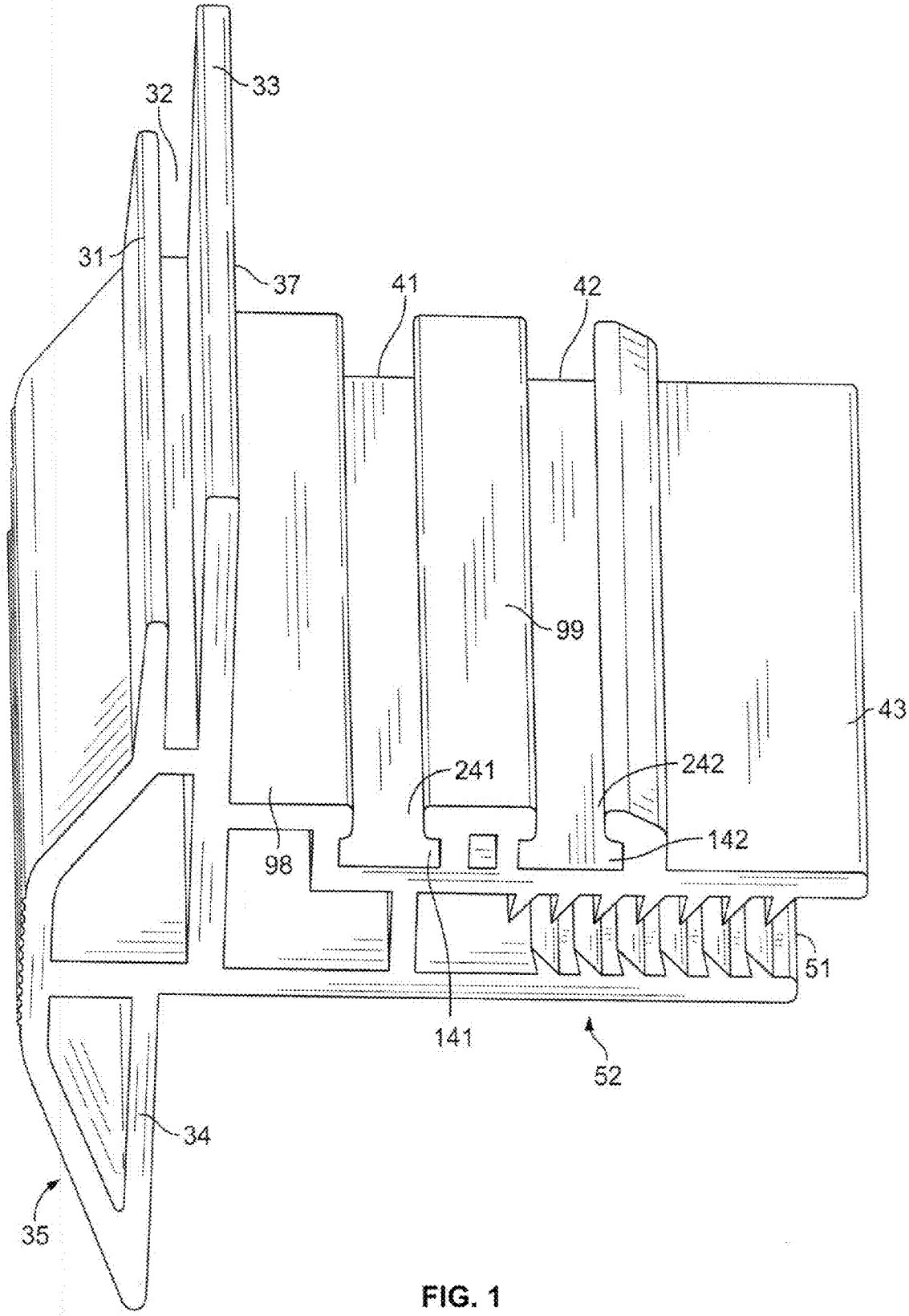
FIG. 1 is a perspective view of the outside frame member.
Figure 2:
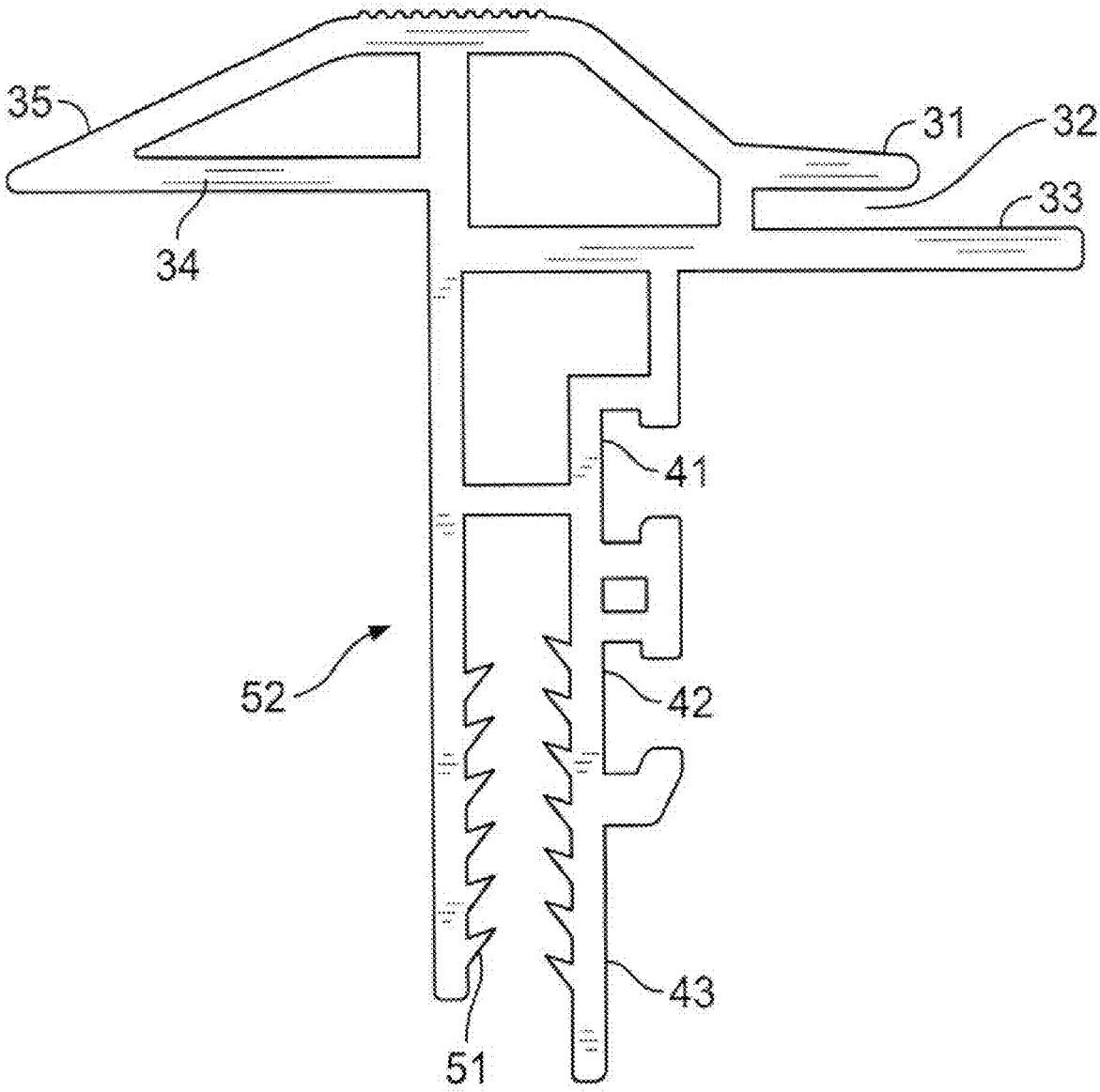
FIG. 2 is a right side perspective view of the outside frame member.
Figure 3:
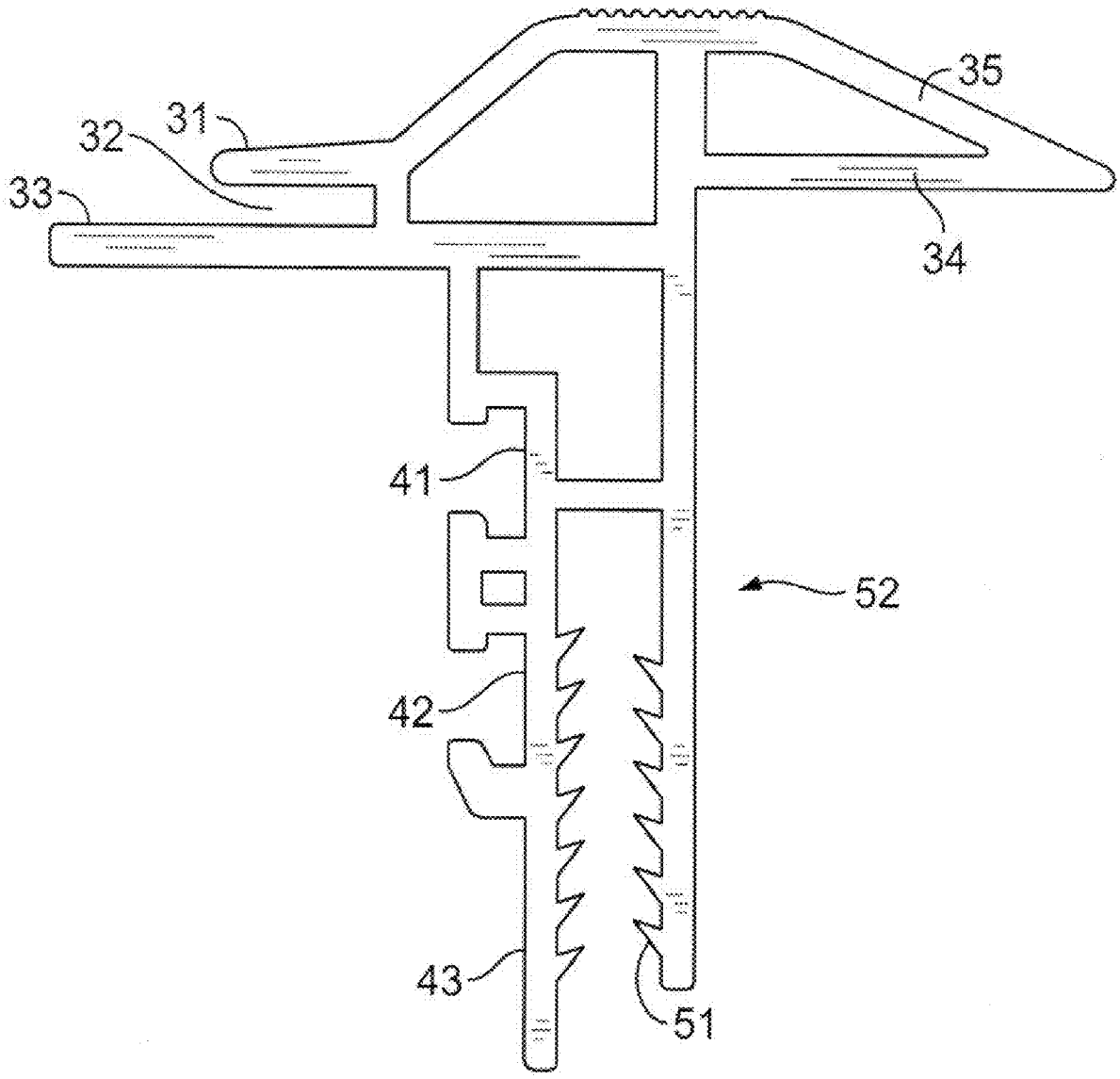
FIG. 3 is a left side perspective view of the outside frame member.
Figure 4:
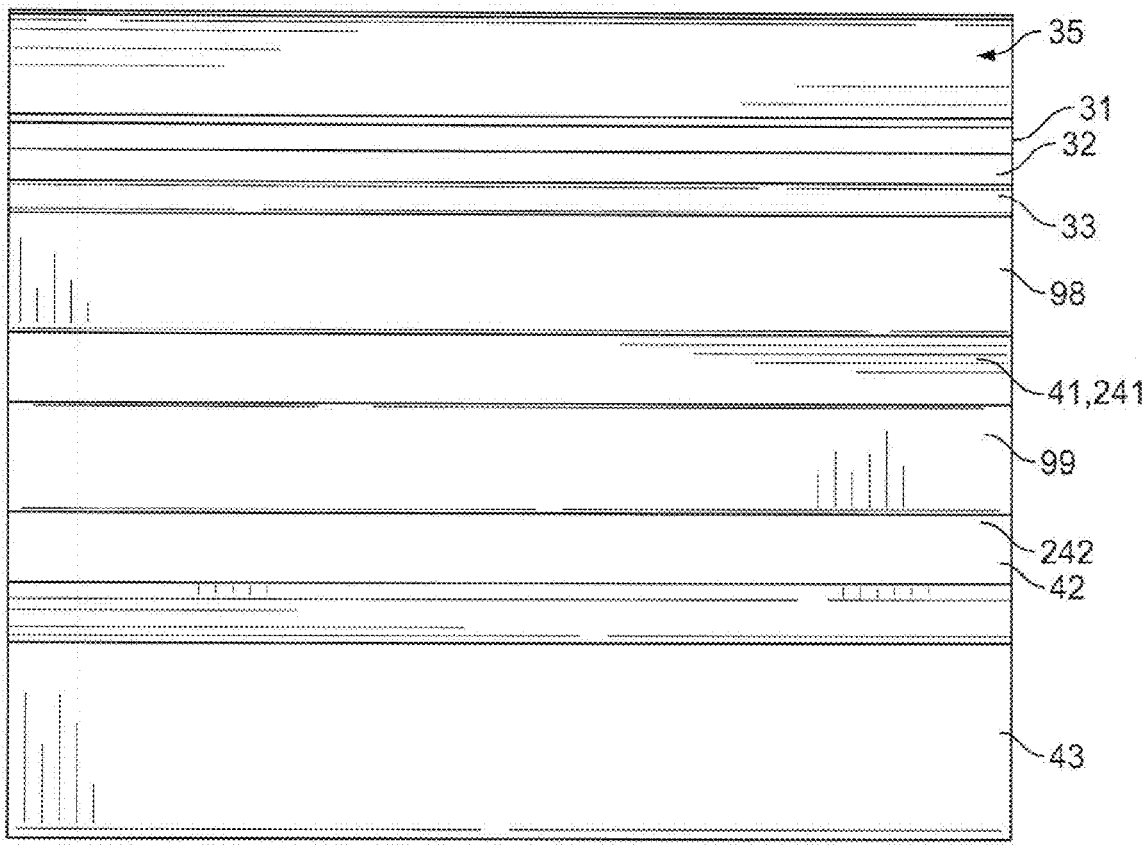
FIG. 4 is a bottom view of the outside frame member.
Figure 5:
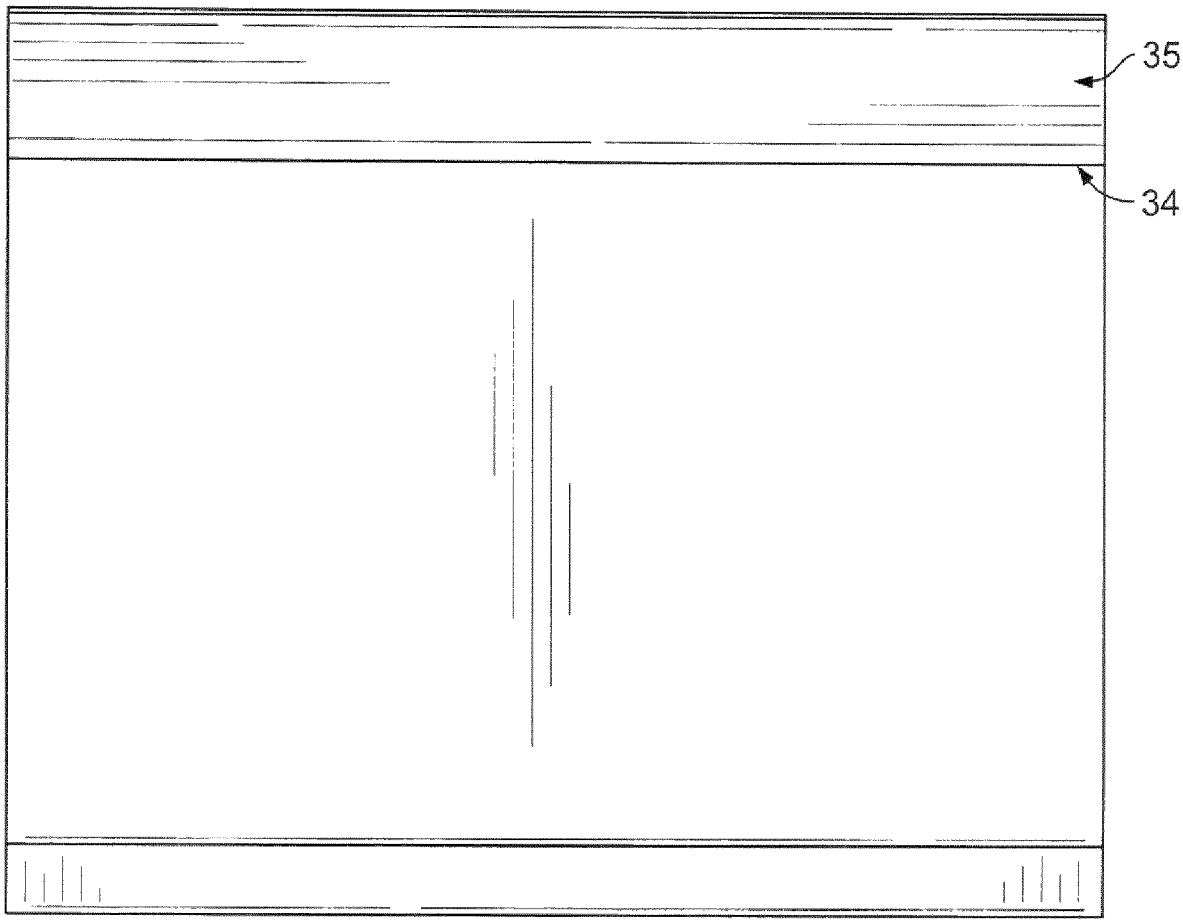
FIG. 5 is a top view of the outside frame member.
Figure 6:
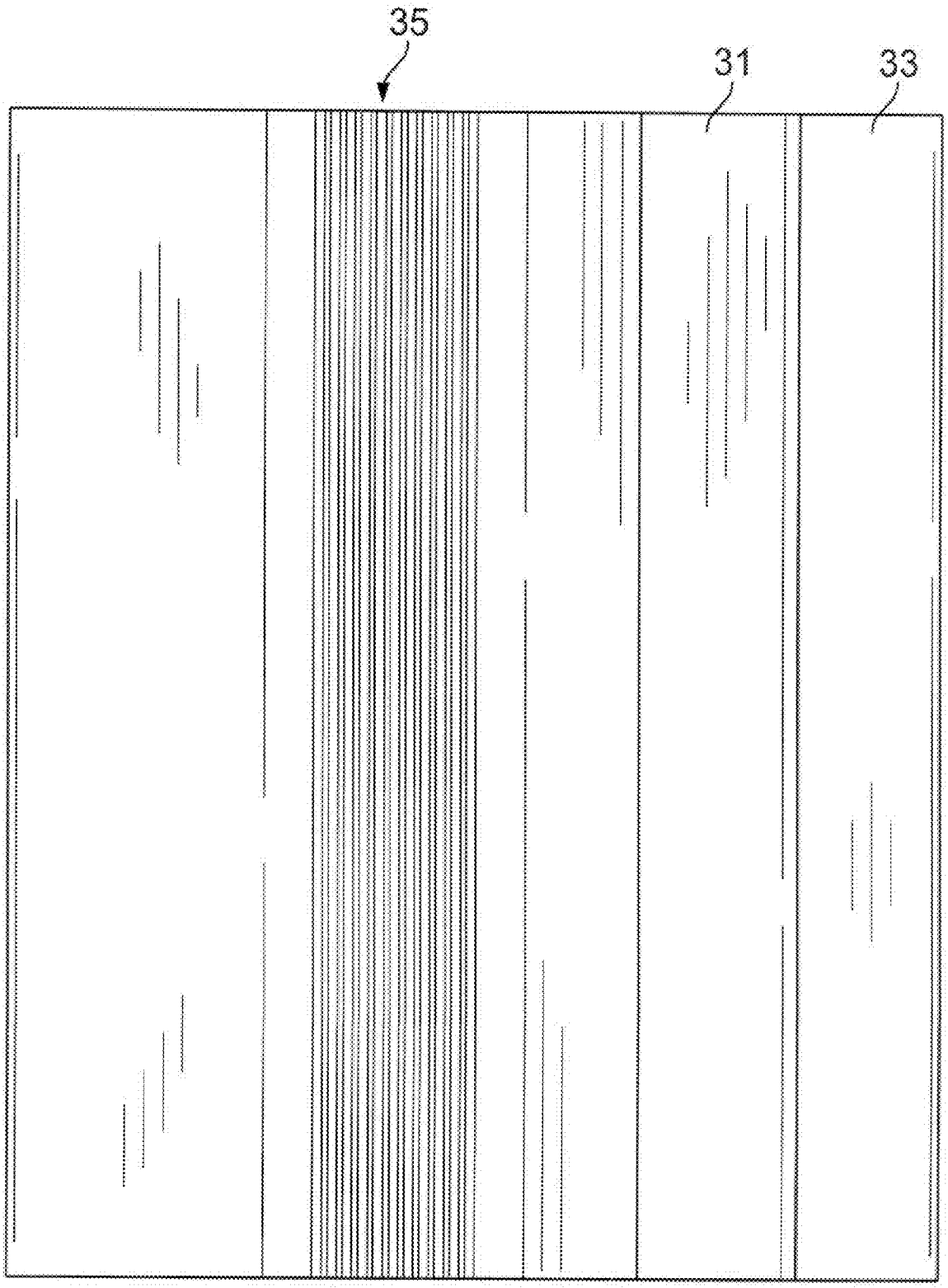
FIG. 6 is a front view of the outside frame member.
Figure 7:
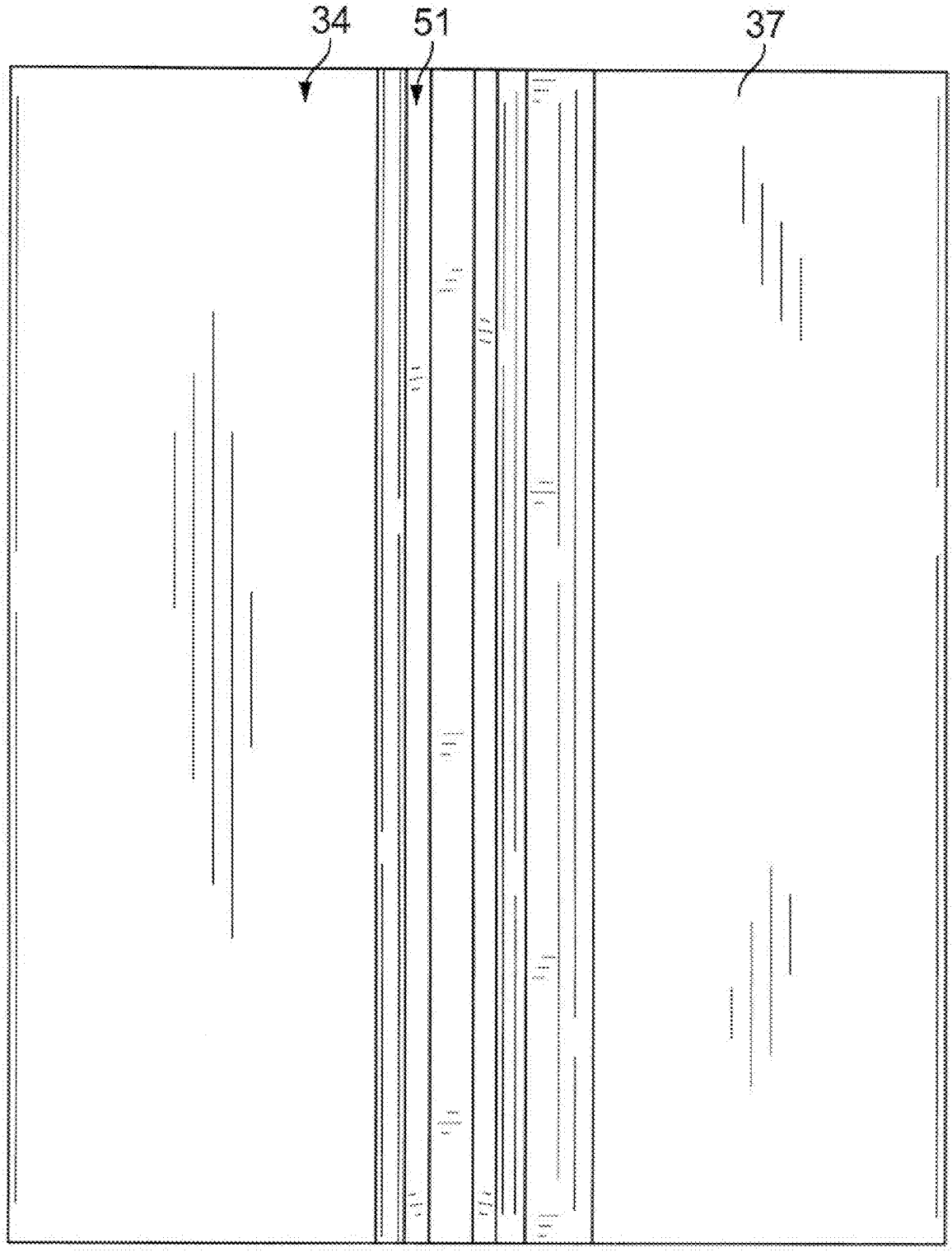
FIG. 7 is a rear view of the outside frame member.
Figure 8:
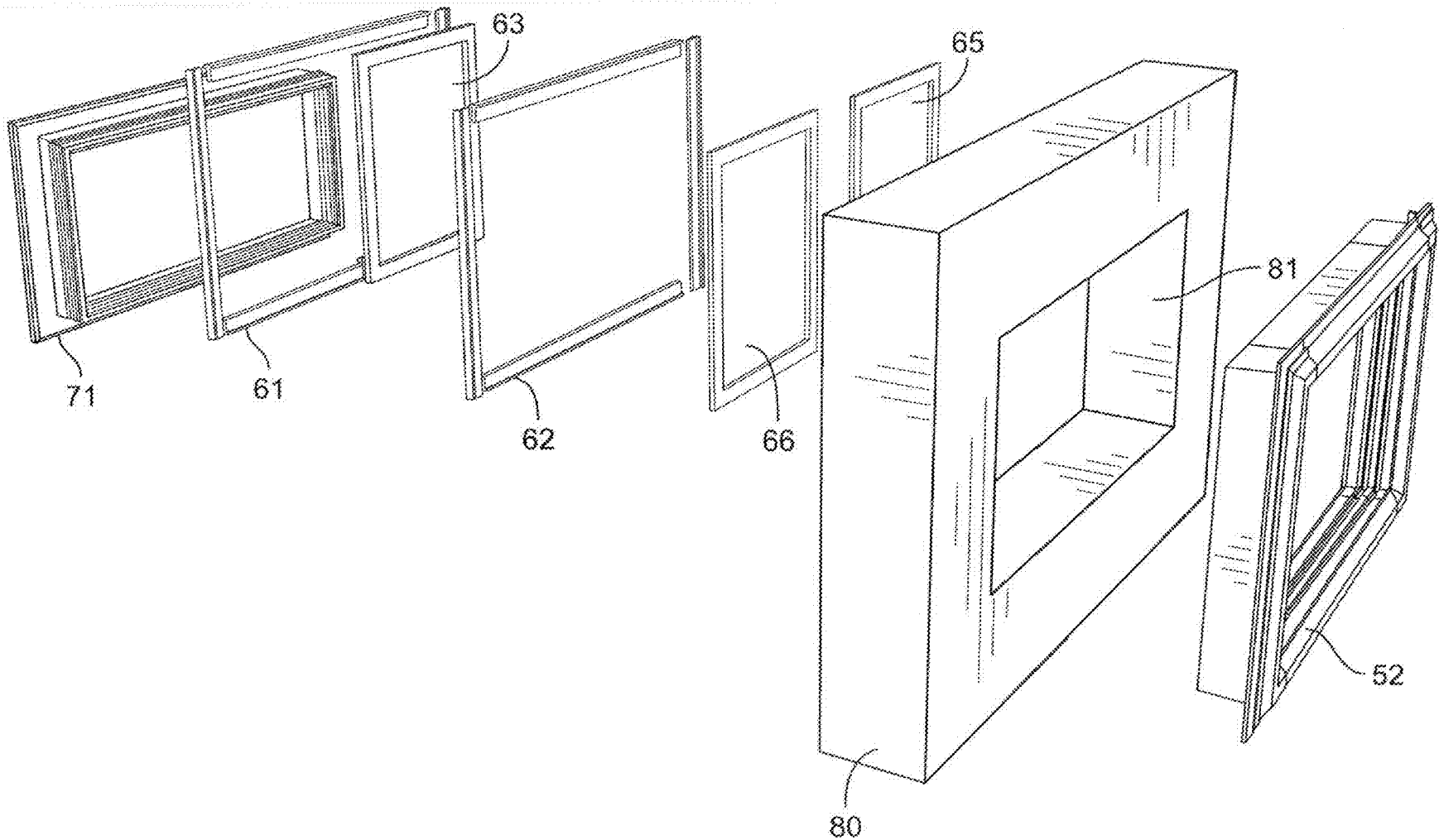
FIG. 8 is an exploded outside view showing assembly of the present invention.
Figure 9:
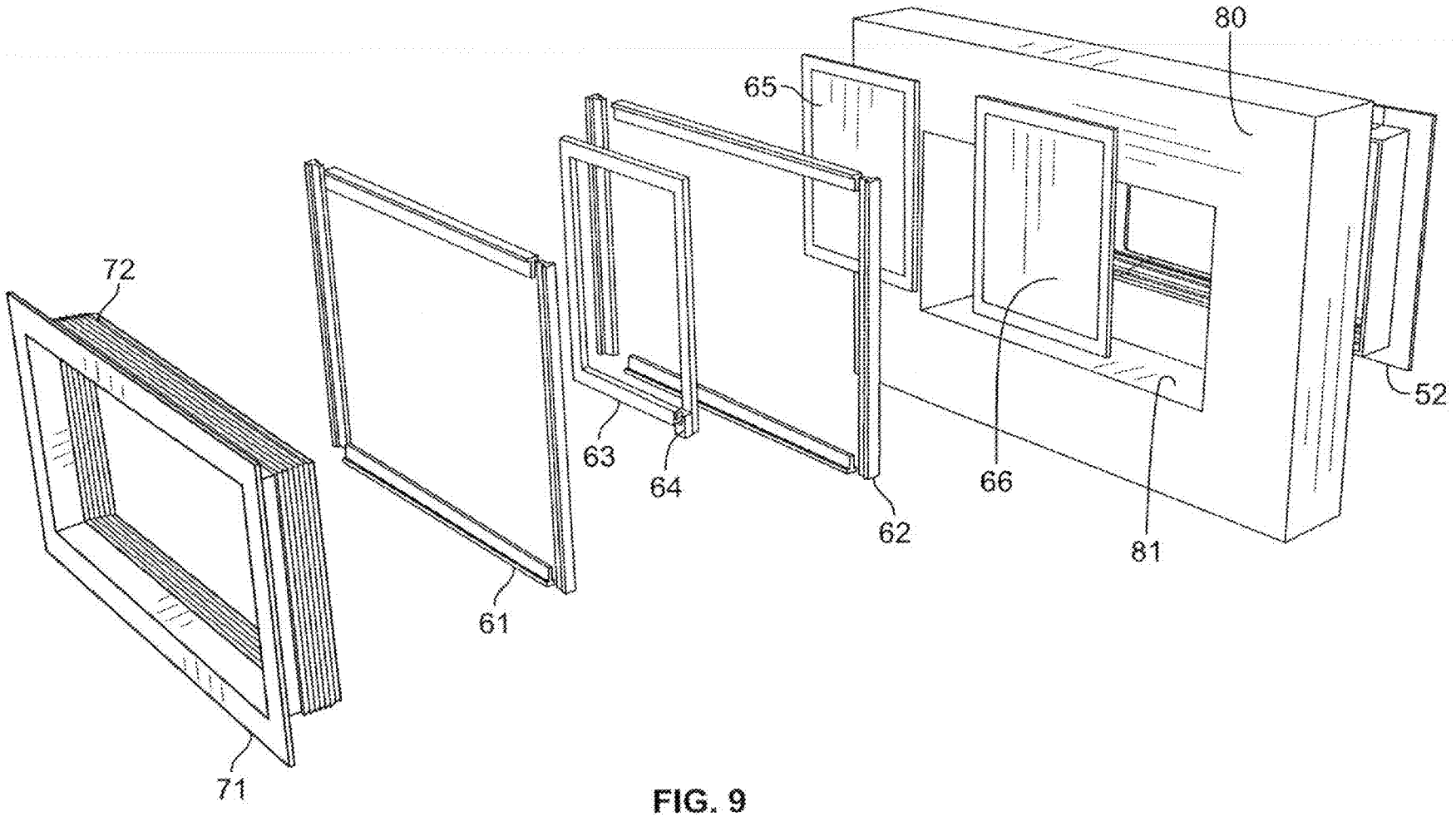
FIG. 9 is an exploded inside view showing assembly of the present invention.
Figure 10:
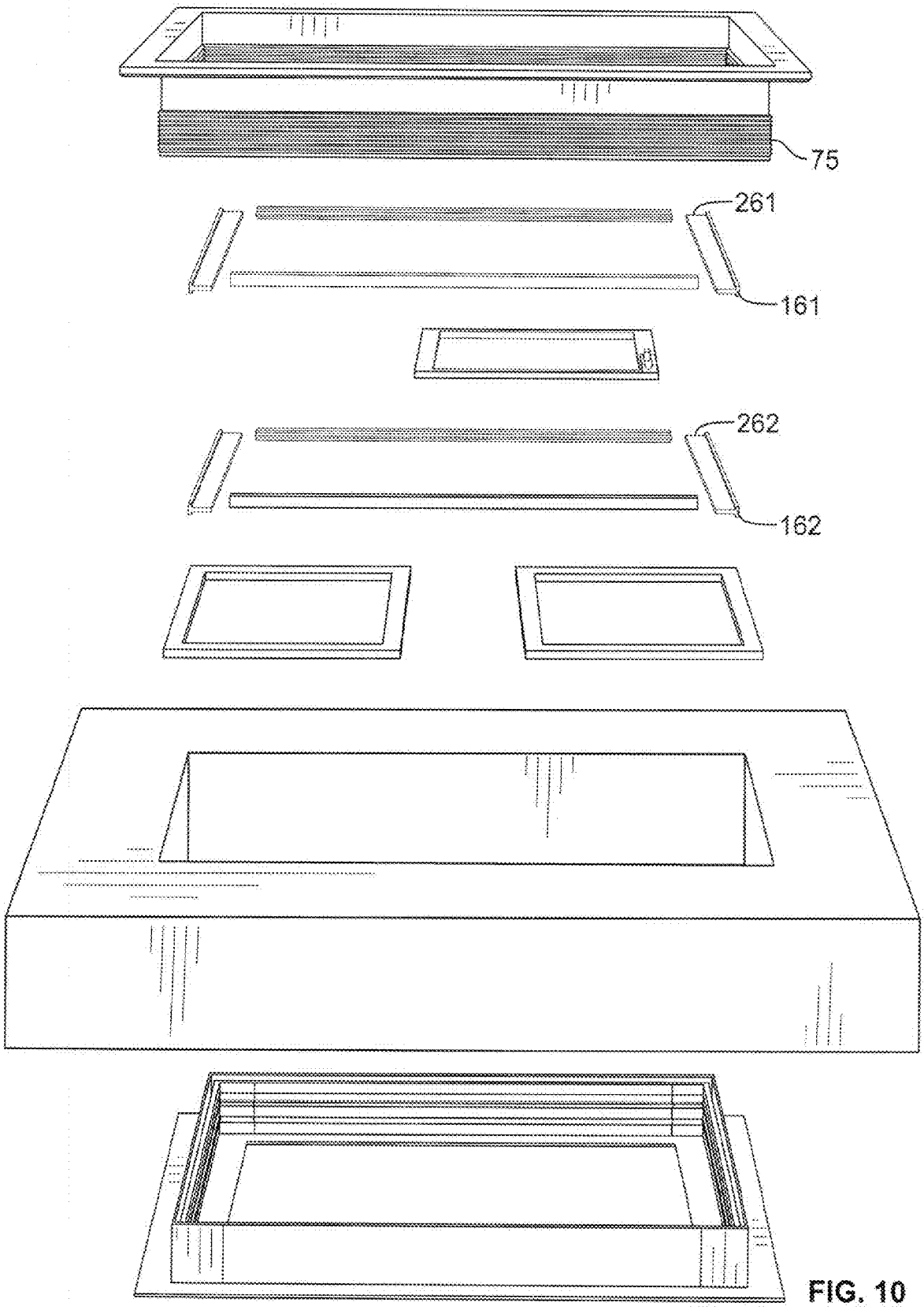
FIG. 10 is a vertically exploded view of the present invention showing assembly.
Figure 11:
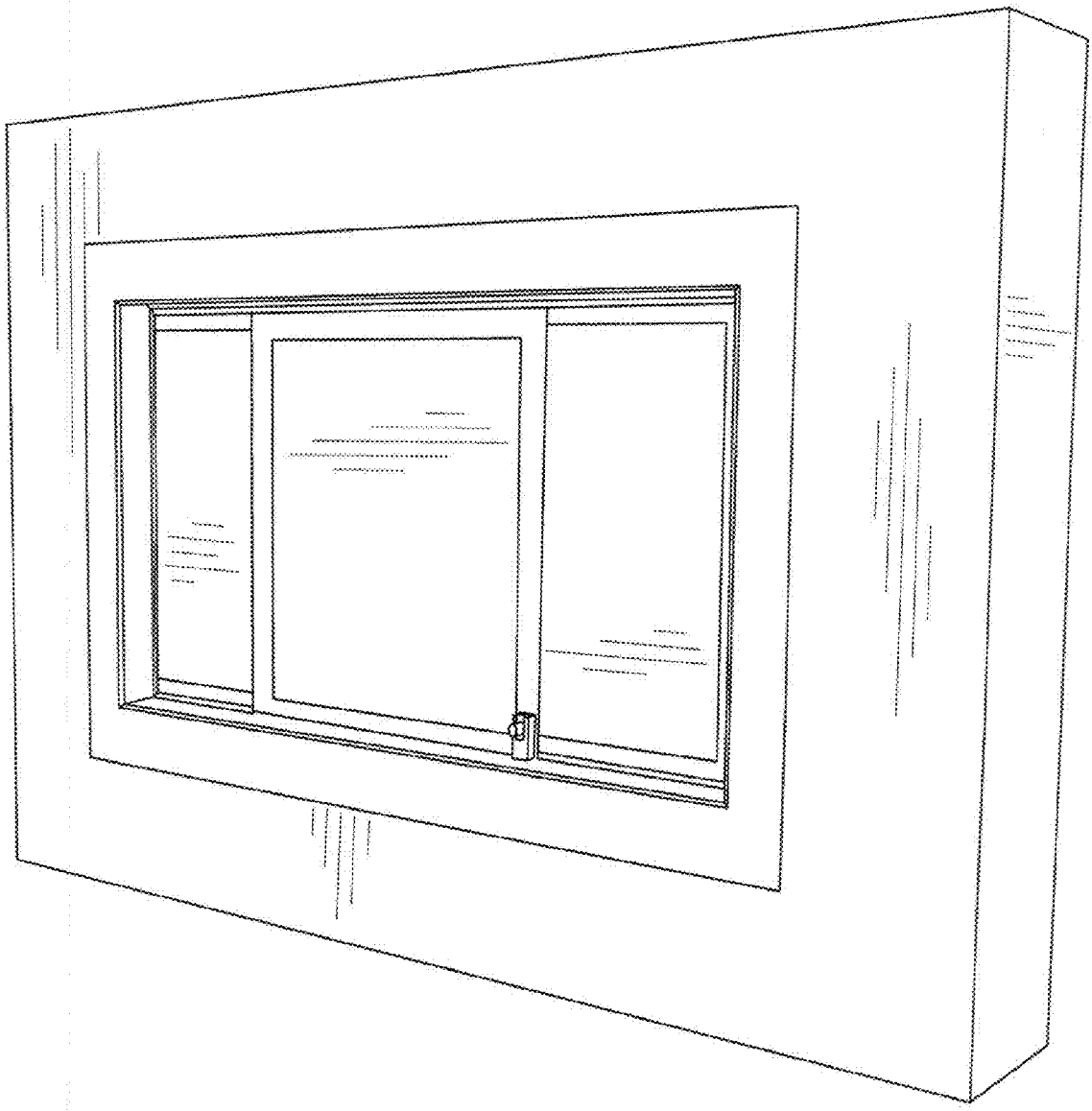
FIG. 11 is an inside view of the assembled garage door window.
Figure 12:
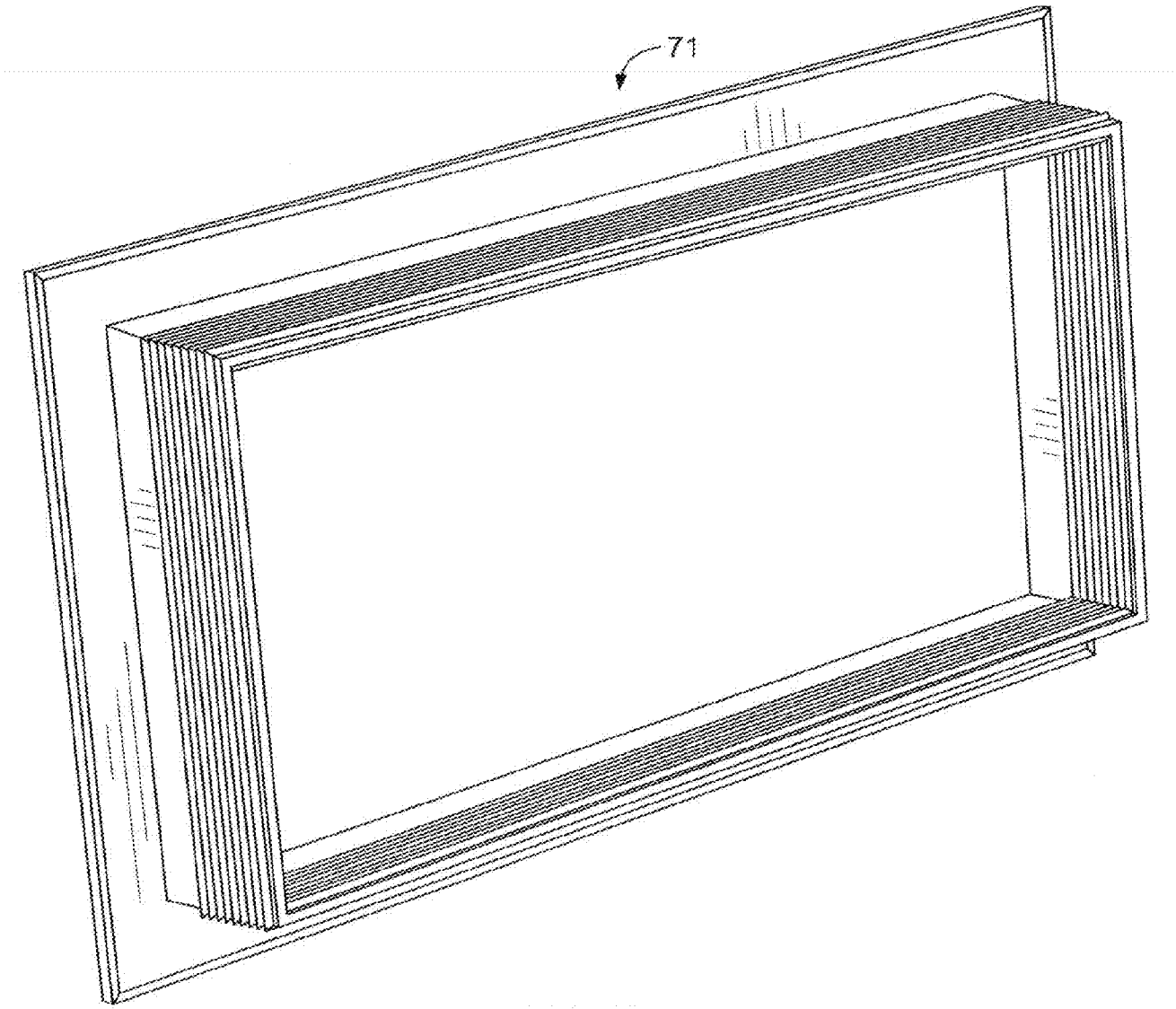
FIG. 12 is a perspective view of the inside frame member.

CALLOUT LIST OF ELEMENTS outside support 31
window design channel 32
inside support 33
peripheral inside face 34
outside face 35
central inside face 37
outside retainer channel 41
inside retainer channel 42
lip 43
inside frame member connection 51
outside frame member 52
inside retainer 61
outside retainer 62
active window 63
locking latch 64
screen 65
fixed window 66
inside frame member 71
inside frame member protrusion 72
garage door opening 81
garage door section 80
outside track 98
inside track 99
outside retainer channel wide portion 141
inside retainer channel wide portion 142
inside retainer wide portion 161
outside retainer wide portion 162
outside retainer channel narrow portion 241
inside retainer channel narrow portion 242
inside retainer narrow portion 261
outside retainer narrow portion 262

DETAILED DESCRIPTION OF THE PREFERRED EMBODIMENT

The outside frame member 52 has a connection with the inside frame member 71. The other parts are mounted on the outside frame member 52. The outside frame member 52 sandwiches together with the inside frame member 71 so that they sandwich together onto a garage door opening 81 on a garage door section 80. An inside frame member connection is a connection for connecting with the inside frame member. The inside frame member connection 51 disposed on the outside frame member of 52 is preferably formed as a slot with a plurality of tooth like or saw like projections for grabbing onto the inside frame member. The tooth projections of the inside frame member connection 51 are preferably opposing and angled outwardly on an upper and lower surface of the slot which receives an inside frame member protrusion 72. An inside frame member protrusion is a protrusion on the inside frame member. The inside frame member protrusion 72 also has protruding tooth projections that are slanted outwardly engaging with the outwardly slanted protruding tooth projections of the inside frame member connection 51. The protruding tooth projections of the inside frame member protrusion 72 and the protruding tooth projections of the inside frame member connection 51 both can bend or have elastic or inelastic deformation so that they can engage with each other. Also, the lip 43 can be biased by the push fit of the protruding tooth projections for additional locking strength or resilience. When connected, the outside frame member and the inside frame member define a window opening.

The outside frame member 52 has an outside face 3-5 which is exposed to the elements. The outside face 35 opposes a peripheral inside face 34 which abuts the garage door section. An outside support 31 is formed as a wall and an inside support 33 is also formed as a wall which form a window design channel 32 between them. The window design channel 32 is sized to receive a variety of ornamental window designs such as a grid or a starburst. A wide variety of ornamental window designs can fit in the window design channel 32. The window design channel 32 receives a flexible window design which is typically made of a pliable plastic that can be bent for fitting within the window design channel 32.

The inside support 33 has a central inside face 37. The central inside face 37 retains a pair of fixed members which includes a screen 65 and a fixed window 66. The screen 65 and the fixed window 66 are both fixed and not movable. They are also both parallel to each other on the same plane, each preferably taking up half of the window opening. Preferably, the screen 65 has a screen frame that abuts the fixed window frame of the fixed window.

The outside retainer channel 41 and the inside retainer channel 42 are disposed as a pair of retainer channels. The retainer channels retain a pair of retainers, namely an inside retainer and an outside retainer. The retainers are stick like and have flexibility because they are preferably shaped as bar like rectangular cross-section members having a thick and thin portion with the predominant part being the thin portion. The retainers preferably fit into the retainer channels by snap fit installation, and optionally glue can be used, but is not preferred so that the retainers can be nondestructively removed from the retainer channels. Once in the retainer channel, a retainer has resistance against bending and movement which would lead it to fall out, but not necessarily against sliding along the direction of the length of the retainer channel. Preferably, the retainer channel and the retainer have a snug fit, although that is optional. The dimensions shown in the figures can be altered or adapted in shape if necessary for suiting a variety of different configurations.

The outside retainer channel 41 receives outside retainer 62. The outside retainer 62 can be made of multiple parts. Preferably, the outside retainer 62 is made of a top outside retainer, a bottom outside retainer, a left outside retainer, and a right outside retainer for a total of four linearly oriented parts. The outside retainer has an outside retainer narrow portion 262 and an outside retainer wide portion 162. The outside retainer wide portion 162 fits in the outside retainer channel wide portion 141. The outside retainer narrow portion 262 fits in the outside retainer channel narrow portion 241. Analogously, the inside retainer channel 42 receives an inside retainer 61 which can also be made of multiple parts. The inside retainer 61 is preferably made of a top inside retainer, a bottom inside retainer, a left inside retainer and a right inside retainer for a total of four linearly oriented parts. The upper outside retainer fits in an upper outside retainer channel, the lower outside retainer fits in a lower outside retainer channel, the left outside retainer fits in a left outside retainer channel, and the right outside retainer fits in a right outside retainer channel. The upper inside retainer fits in an upper inside retainer channel, the lower inside retainer fits in a lower inside retainer channel, the left inside retainer fits in a left inside retainer channel, and the right inside retainer fits in a right inside retainer channel.

The inside retainer 61 preferably includes an inside retainer wide portion 161 and an inside retainer narrow portion 261. The inside retainer wide portion 161 snaps into the inside retainer channel wide portion 142, and the inside retainer narrow portion 261 preferably fits into the inside retainer channel narrow portion 242. Both the outside retainer channel 41 and the inside retainer channel 42 have a flat surface which preferably abuts a flat surface of the inside retainer wide portion 161 and a flat surface of the outside retainer wide portion 162. Optionally, the top inside retainer, bottom inside retainer, top outside retainer, and bottom outside retainer are the only retainer members.

After the retainers are inserted into the retainer channels, a pair of tracks is formed. An outside track 98 is formed between the central inside face 37 of the inside support 33 and the outside retainer. An inside track 99 is formed between the outside retainer and the inside retainer. The tracks, namely the pair of tracks are channel shaped as shown in the drawings, and can also be notch shaped. The screen 65 is a typical window screen allowing air to pass through, but having mesh for the purpose of keeping out insects. The screen 65 is mounted on about half of a surface area of the window. The screen 65 and the fixed window 66 are preferably mounted on the outside track 98. The active window 63 is preferably formed of a glass material similar to the fixed window 66. The active window 63 may also include a locking latch 64 that engages the inside track 99 for locking the active window 63. The active window 63 is preferably slidably mounted on the inside track 99. The lock latch 64 may have a protrusion that engages a depression disposed on a surface of the inside track 99. Alternatively, the lock latch 64 may be friction only engaged with a surface of the inside track 99.

During installation, a user first presses the outside frame member 52 onto the outside of the garage door section 80. The user aligns the outside frame member 52 so that the peripheral inside face 34 meets the outside surface of the garage door section 80. The user also a lines the outside frame member 52 so that the lip 43 passes through the garage door opening 81. The garage door section 80 is preferably made of a metal or plastic as is commonly known in the industry. Sometimes, the garage door section 80 has insulation. The user can then place the screen and the fixed window against the central inside face 37. The user can then install the outside retainer. The user can then install the active window and hold the active window in place with the inside retainer 61. The user can then push the inside frame member 71 having the inside frame member protrusion 72 aligned with the inside frame member connection 51 so that the frame members become snapped together with each other.

Alternatively, a user can first install the outside frame member against the inside frame member. In this installation, the user can grasp the interface of the outside frame member 52 against the inside frame member 71 using opposable digits. The user then installs the screen and fixed window, followed by the outside retainer for retaining the screen and fixed window. The user can then install the active window followed by the inside retainer for retaining the active window. After installing the active window 63, the user may wish to test the active window by sliding the active window from a closed position to an open position, and then sliding the active window between the open and closed positions.

Preferably, the active window is snug enough to fit in the outside track 98 so that it does not rattle when the garage door is opened. Also, the active window should not be so snug as to have difficulty opening. A user can open the active window to allow airflow through the screen. If a window is broken, the user can remove the inside retainer for replacing the active window, and the user can remove the inside retainer, active window and the outside retainer for replacing the fixed window.

The invention claimed is:

1. A garage door window comprising:

a. an outside frame member, wherein the outside frame member has an inside frame member connection, wherein the outside frame member has an outside face exposed to the elements and wherein the outside frame member has a peripheral inside face for abutting a garage door section;

b. an inside frame member, wherein the inside frame member has a protrusion connecting with the inside frame member connection, wherein the outside frame member and the inside frame member define a window opening;

c. an outside retainer channel;

d. an inside retainer channel;

e. an outside retainer fitting within the outside retainer channel, wherein the outside retainer is nondestructively removable and connected to the outside retainer channel by a snap fit;

f. an inside retainer fitting within the inside retainer channel, wherein the inside retainer is nondestructively removable and connected to the inside retainer channel by a snap fit;

g. an outside track formed on the outside frame member, between a central inside face of the outside frame member and the outside retainer;

h. an inside track formed on the outside frame member, between the outside retainer and the inside retainer;

i. a screen mounted on the outside track;

j. a fixed window mounted on the outside track; and k. an active window mounted on the inside track.

2. The garage door window of claim 1, further comprising:

a. inside frame member connection tooth projections disposed on opposing surfaces of the inside frame member connection, wherein the inside frame member connection is formed as a slot;

b. inside frame member tooth projections disposed on the protrusion of the inside frame member, wherein the inside frame member tooth projections engage with the inside frame member connection tooth projections when the outside frame member is snap fit against inside frame member.

3. The garage door window of claim 1, further comprising:

a. an inside retainer narrow portion and an inside retainer wide portion;

b. an inside retainer channel narrow portion receiving the inside retainer narrow portion, and an inside retainer channel wide portion receiving the inside retainer wide portion;

c. an outside retainer narrow portion and an outside retainer wide portion; and d. an outside retainer channel narrow portion receiving the outside retainer narrow portion, and an outside retainer channel wide portion receiving the outside retainer wide portion.

4. The garage door window of claim 1, further comprising:

a. a window design channel disposed between the inside support disposed on the outside frame member and an outside support disposed on the outside frame member, and b. a lip protruding inward from an upper portion of the inside frame member connection.

5. The garage door window of claim 1, further comprising an upper outside retainer, a lower outside retainer, a left outside retainer, and a right outside retainer as separate linearly oriented subelements of the outside retainer, wherein the upper outside retainer fits in an upper outside retainer channel, wherein the lower outside retainer fits in a lower outside retainer channel, wherein the left outside retainer fits in a left outside retainer channel, and wherein the right outside retainer fits in a right outside retainer channel; and an upper inside retainer, a lower inside retainer, a left inside retainer and a right inside retainer as separate linearly oriented subelements of the inside retainer, wherein the upper inside retainer fits in an upper inside retainer channel, wherein the lower inside retainer fits in a lower inside retainer channel, wherein the left inside retainer fits in a left inside retainer channel, and wherein the right inside retainer fits in a right inside retainer channel.

6. The garage door window of claim 5, further comprising:

a. inside frame member connection tooth projections disposed on opposing surfaces of the inside frame member connection, wherein the inside frame member connection is formed as a slot;

b. inside frame member tooth projections disposed on the protrusion of the inside frame member, wherein the inside frame member tooth projections engage with the inside frame member connection tooth projections when the outside frame member is snap fit against inside frame member.

7. The garage door window of claim 5, further comprising:

a. an inside retainer narrow portion and an inside retainer wide portion;

b. an inside retainer channel narrow portion receiving the inside retainer narrow portion, and an inside retainer channel wide portion receiving the inside retainer wide portion;

c. an outside retainer narrow portion and an outside retainer wide portion; and d. an outside retainer channel narrow portion receiving the outside retainer narrow portion, and an outside retainer channel wide portion receiving the outside retainer wide portion.

8. The garage door window of claim 5, further comprising:

a. a window design channel disposed between the inside support disposed on the outside frame member and an outside support disposed on the outside frame member, and b. a lip protruding inward from an upper portion of the inside frame member connection.

9. The garage door window of claim 5, further comprising:

a. an inside retainer narrow portion and an inside retainer wide portion;

b. an inside retainer channel narrow portion receiving the inside retainer narrow portion, and an inside retainer channel wide portion receiving the inside retainer wide portion;

c. an outside retainer narrow portion and an outside retainer wide portion; and d. an outside retainer channel narrow portion receiving the outside retainer narrow portion, and an outside retainer channel wide portion receiving the outside retainer wide portion;

e. a window design channel disposed between the inside support disposed on the outside frame member and an outside support disposed on the outside frame member, and f. a lip protruding inward from an upper portion of the inside frame member connection.

10. The garage door window of claim 1, further comprising:

a. inside frame member connection tooth projections disposed on opposing surfaces of the inside frame member connection, wherein the inside frame member connection is formed as a slot;

b. inside frame member tooth projections disposed on the protrusion of the inside frame member, wherein the inside frame member tooth projections engage with the inside frame member connection tooth projections when the outside frame member is snap fit against inside frame member;

c. an inside retainer narrow portion and an inside retainer wide portion;

d. an inside retainer channel narrow portion receiving the inside retainer narrow portion, and an inside retainer channel wide portion receiving the inside retainer wide portion;

e. an outside retainer narrow portion and an outside retainer wide portion; and f. an outside retainer channel narrow portion receiving the outside retainer narrow portion, and an outside retainer channel wide portion receiving the outside retainer wide portion.

11. The garage door window of claim 10, further comprising:

a. a window design channel disposed between the inside support disposed on the outside frame member and an outside support disposed on the outside frame member; and b. a lip protruding inward from an upper portion of the inside frame member connection, further comprising an upper outside retainer, a lower outside retainer, a left outside retainer, and a right outside retainer as separate linearly oriented subelements of the outside retainer, wherein the upper outside retainer fits in an upper outside retainer channel, wherein the lower outside retainer fits in a lower outside retainer channel, wherein the left outside retainer fits in a left outside retainer channel, and wherein the right outside retainer fits in a right outside retainer channel; and an upper inside retainer, a lower inside retainer, a left inside retainer and a right inside retainer as separate linearly oriented subelements of the inside retainer, wherein the upper inside retainer fits in an upper inside retainer channel, wherein the lower inside retainer fits in a lower inside retainer channel, wherein the left inside retainer fits in a left inside retainer channel, and wherein the right inside retainer fits in a right inside retainer channel.

12. A garage door window comprising:

a. an outside frame member, wherein the outside frame member has an inside frame member connection, wherein the outside frame member has an outside face exposed to the elements and wherein the outside frame member has a peripheral inside face;

b. an inside frame member, wherein the inside frame member has a protrusion connecting with the inside frame member connection, wherein the outside frame member and the inside frame member define a window opening;

c. an outside retainer channel;

d. an inside retainer channel;

e. an outside retainer fitting within the outside retainer channel, wherein the outside retainer is nondestructively removable and connected to the outside retainer channel;

f. an inside retainer fitting within the inside retainer channel, wherein the inside retainer is nondestructively removable and connected to the inside retainer channel;

g. an outside track formed on the outside frame member, between a central inside face of the outside frame member and the outside retainer;

h. an inside track formed on the outside frame member, between the outside retainer and the inside retainer;

i. a screen mounted on the outside track;

j. a fixed window mounted on the outside track;

k. an active window mounted on the inside track;

l. a window design member attaching to the outside frame member.

13. The garage door window of claim 12, further comprising:

a. inside frame member connection tooth projections disposed on opposing surfaces of the inside frame member connection, wherein the inside frame member connection is formed as a slot;

b. inside frame member tooth projections disposed on the protrusion of the inside frame member, wherein the inside frame member tooth projections engage with the inside frame member connection tooth projections when the outside frame member is snap fit against inside frame member.

14. The garage door window of claim 12, further comprising:

a. an inside retainer narrow portion and an inside retainer wide portion;

b. an inside retainer channel narrow portion receiving the inside retainer narrow portion, and an inside retainer channel wide portion receiving the inside retainer wide portion;

c. an outside retainer narrow portion and an outside retainer wide portion; and d. an outside retainer channel narrow portion receiving the outside retainer narrow portion, and an outside retainer channel wide portion receiving the outside retainer wide portion.

15. The garage door window of claim 12, further comprising:

a. a window design channel disposed between the inside support disposed on the outside frame member and an outside support disposed on the outside frame member, and b. a lip protruding inward from an upper portion of the inside frame member connection.

16. The garage door window of claim 12, further comprising an upper outside retainer, a lower outside retainer, a left outside retainer, and a right outside retainer as separate linearly oriented subelements of the outside retainer, wherein the upper outside retainer fits in an upper outside retainer channel, wherein the lower outside retainer fits in a lower outside retainer channel, wherein the left outside retainer fits in a left outside retainer channel, and wherein the right outside retainer fits in a right outside retainer channel; and an upper inside retainer, a lower inside retainer, a left inside retainer and a right inside retainer as separate linearly oriented subelements of the inside retainer, wherein the upper inside retainer fits in an upper inside retainer channel, wherein the lower inside retainer fits in a lower inside retainer channel, wherein the left inside retainer fits in a left inside retainer channel, and wherein the right inside retainer fits in a right inside retainer channel.

17. The garage door window of claim 12, further comprising:

a. inside frame member connection tooth projections disposed on opposing surfaces of the inside frame member connection, wherein the inside frame member connection is formed as a slot;

b. inside frame member tooth projections disposed on the protrusion of the inside frame member, wherein the inside frame member tooth projections engage with the inside frame member connection tooth projections when the outside frame member is snap fit against inside frame member;

c. an inside retainer narrow portion and an inside retainer wide portion;

d. an inside retainer channel narrow portion receiving the inside retainer narrow portion, and an inside retainer channel wide portion receiving the inside retainer wide portion;

e. an outside retainer narrow portion and an outside retainer wide portion; and f. an outside retainer channel narrow portion receiving the outside retainer narrow portion, and an outside retainer channel wide portion receiving the outside retainer wide portion.

18. The garage door window of claim 12, further comprising:

a. a window design channel disposed between the inside support disposed on the outside frame member and an outside support disposed on the outside frame member;

b. a lip protruding inward from an upper portion of the inside frame member connection; and c. an upper outside retainer, a lower outside retainer, a left outside retainer, and a right outside retainer as separate linearly oriented subelements of the outside retainer, wherein the upper outside retainer fits in an upper outside retainer channel, wherein the lower outside retainer fits in a lower outside retainer channel, wherein the left outside retainer fits in a left outside retainer channel, and wherein the right outside retainer fits in a right outside retainer channel; and an upper inside retainer, a lower inside retainer, a left inside retainer and a right inside retainer as separate linearly oriented subelements of the inside retainer, wherein the upper inside retainer fits in an upper inside retainer channel, wherein the lower inside retainer fits in a lower inside retainer channel, wherein the left inside retainer fits in a left inside retainer channel, and wherein the right inside retainer fits in a right inside retainer channel.

* * * * *